United States Patent [19]

McConkey

[11] Patent Number: 4,986,617

[45] Date of Patent: Jan. 22, 1991

[54] PSYCHOLOGICALLY STIMULATING CHANGING APPARATUS

[75] Inventor: Laura P. McConkey, Wilmington, Del.

[73] Assignee: University of Delaware, Newark, Del.

[21] Appl. No.: 754,325

[22] Filed: Jul. 12, 1985

[51] Int. Cl.[5] ..... A47B 83/00

[52] U.S. Cl. ..... 312/237; 312/235.1

[58] Field of Search ..... 312/235, 237, 201, 37, 312/226; 269/328; 5/428, 53 R; 297/148

[56] References Cited

U.S. PATENT DOCUMENTS

| | | | |
|---|---|---|---|
| 1,127,139 | 2/1915 | West . | |
| 1,952,216 | 3/1934 | Owings . | |
| 2,402,861 | 6/1946 | Winnick | 297/148 X |
| 2,479,736 | 8/1949 | Fieroh | 312/235 R |
| 2,775,499 | 12/1956 | Gleitsman | 312/235 R |
| 2,858,641 | 11/1958 | Trimble . | |
| 2,963,332 | 12/1960 | Breuning | 312/235 R |
| 3,313,584 | 4/1967 | Rocker | 312/237 X |
| 3,338,648 | 8/1967 | Bannister | 312/237 X |
| 3,736,603 | 6/1973 | Rothman | 5/53 R |

FOREIGN PATENT DOCUMENTS

| | | | |
|---|---|---|---|
| 2632 | 7/1926 | Australia | 312/226 |

OTHER PUBLICATIONS

*Young Children* (6 pp.), Highberger & Boynton, "Prevent Illness in Infant/Toddler Day Care," 3-1983.

*Wall Street Journal* (1 p.), Thomas E. Ricks "Researchers Say Day-Care Centers are Implicated in Spread of Disease", 9-1984.

*Child Health Alert* (2 pp.), Paula L. Mitchell, Editor, "Intestinal Parasites in Day Care Centers", 10-1984.

*Primary Examiner*—Peter A. Aschenbrenner

*Attorney, Agent, or Firm*—James H. Ryan

[57] ABSTRACT

Described and claimed is a changing apparatus for an infant or young child comprising an elevated table with means for stimulating the interest of the child in changing or helping to change himself. The means for stimulating interest include steps or a ladder which the child can use by himself to reach the top of the table, an adjustable mirror in which the child can see his reflection and assist in changing himself, and compartments for storing individual items for individual children.

8 Claims, 1 Drawing Sheet

PSYCHOLOGICALLY STIMULATING CHANGING APPARATUS

BACKGROUND OF THE INVENTION

1. Field of Invention

This invention relates to, and has as its principal object provision of, a changing table for a young child having means to stimulate the imagination of the child to assist in changing himself.

2. Prior Art

Changing tables for infants or young children have long been known as shown, for example, by Crocker U.S. Pat. No. 349,875, "Infant'3 s Toilet Table" (1986), and Jiranek U.S. Pat. No. 1,082,082, "Sanitary Baby Dresser" (1913). Such tables having means engaging the imagination of the child so that he will assist in changing himself are, however, believed novel. Furthermore, the known tables have been built for the use of individual children, rather than the many accommodated by the sanitary table now provided.

DESCRIPTION OF THE INVENTION

The present invention will be most easily understood with reference to the drawings in which.

Figure 2:
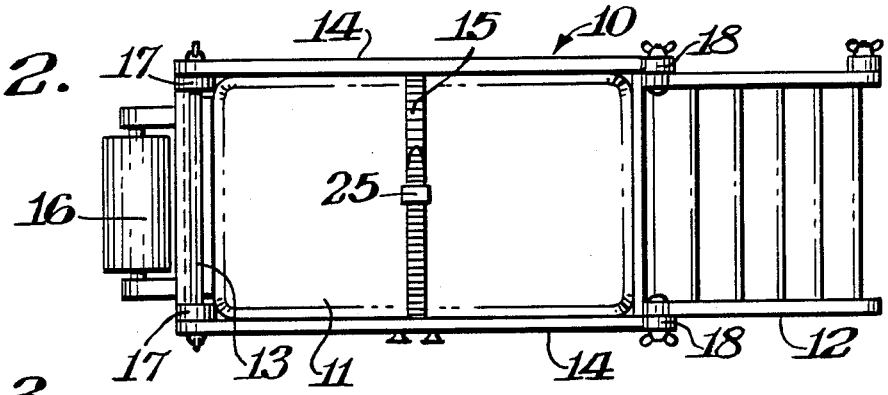
FIG. 2 is a top-plan view of the changing table shown in FIG. 1.
Figure 3:
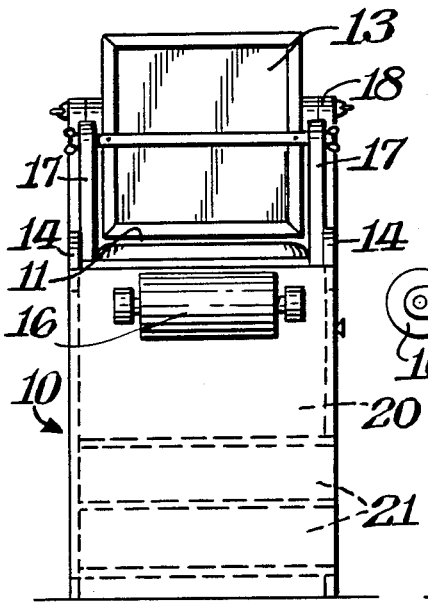
FIG. 3 is a left-end elevational view of the changing table shown in FIGS. 1–2.

In the drawings, a cabinet 10 is shown supporting a flat top 11 on which a child can come for changing. A folding ladder 12 with support 18 is at one end of the cabinet so that the child can climb up by himself. A mirror 13 with support 17 is adjustably positioned at the opposite end of the cabinet permitting the child to see himself while he is being changed and assist in the process. A guard rail 14 extends on the sides of the cabinet lengthwise along flat top 11, and a safety belt 15 is mounted widthwise across the center of the flat top 11 for use as desired. Belt 15 may be provided with clamp or clasp 25 of any suitable type, an adhesive clasp such as one of Velcro® being particularly desirable. A roll of disposable paper 16 is positioned lengthwise along flat top 11 running under belt 15 to assist in maintaining sanitary conditions during and after changing with supports 17 and 18 at the ends of the flat top.

Figure 1:
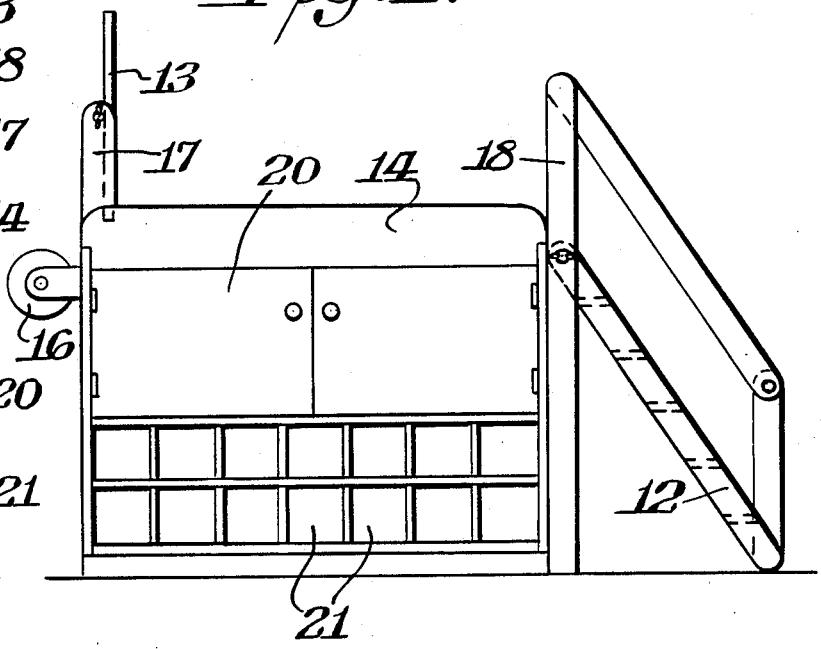
FIG. 1 is a side-elevational view of a first embodiment of the changing table showing particularly means stimulating the imagination of a child.
Figure 4:
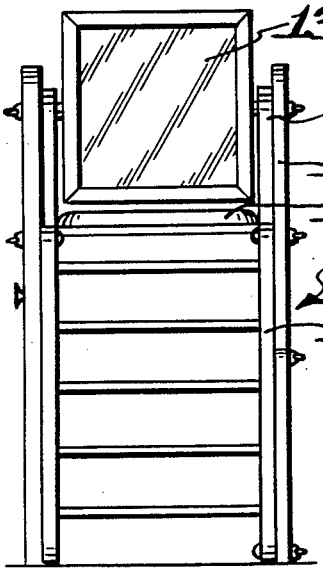
FIG. 4 is a right-end elevational view of the changing table shown in FIGS. 1–3.

Below top 11, cabinet 10 is divided into compartments for storage of diapers and other items, if desired. FIG. 1 illustrates a cabinet 10 containing an upper enclosed storage compartment 20 with hinged doors and a number of lower pigeon-hole storage compartments 21. The lower compartments in particular may be used for individual children for storage of diapers, etc. These compartments may thus aid in psychological stimulation in that the children can be taught to select the appropriately sized diaper from the appropriate compartment. Compartments may also be used for other toilet items such as powder, wet wipes, cotton swabs, and the like (cf. the two patents cited above). Multiple compartments mean also that many children can be accommodated by one table.

Figure 5:
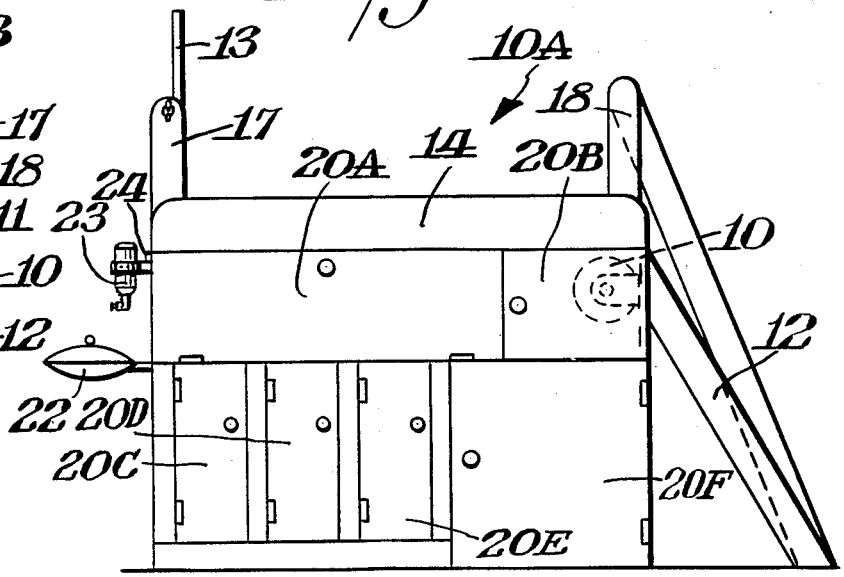
FIG. 5 is a side-elevational view of a second embodiment of the changing table differing from that of FIG. 1 primarily in showing different compartmentation.

As noted, FIG. 5 illustrates a second embodiment of the invention differing from that of FIG. 1 by the compartmentation below the flat top 11. In this embodiment, all the compartments 20A, -B, -C, -D, -E, and -F have hinged doors. Compartments 20A, 20B, and 20F are of various sizes and may be used for storage as desired. The roll of disposable paper 16 is here positioned within compartment 20B with a paper cutter 24 at the opposite end of the flat top. Compartments 20C, -D, and -E are vertical compartments easily accessible from the floor and adapted to contain diapers of three different sizes, e.g., small, medium, and large. A soap dispenser 23 which may contain an antiseptic soap and a waste container 22 are provided as desired.

It is evident from the discussions above that the present changes serve to facilitate the child's own natural power to teach himself. For example, the mirror satisfies the child's sense of curiosity about his own body and movements. Places for children are desirable where they can safely assimilate stimuli from the environment without any need for direct instruction. Full personality development is dependent upon progressive release from external direction and reliance. Thus the child can select his own diaper, climb on to the apparatus to become ready for changing, and observe (by use of the mirror) the process of changing.

A child's positive concept of self is also built through successful interaction with the environment. Trust of the world is encouraged by giving aid only when it is necessary and by offering ways for the child to make decisions for himself. Again, an example is the child choosing his own diaper from the various sizes available or from compartments that contain his own diapers.

The ladder also provides an opportunity for the child to act independently and to develop sensory motor skills. This encourages the child to explore his world in other circumstances.

These educational aspects of the changer are believed unique; other changers in existence simply involve an adult placing the child onto a platform with no external stimuli available nor with the child taking on any responsibility himself.

I claim:

1. A psychologically stimulating changing table for a child comprising:

a. an elevated platform for positioning a child for changing; and b. means combined with said platform for engaging the attention of the child during the changing operation and thereby obtaining the cooperation of the child in the changing process, said means including a mirror at one end of and facing along the length of the platform so that the child can see himself during changing and can assist in the same.

2. The psychologically stimulating changing table of claim 1 wherein the means for engaging the attention of the child includes a ladder up which the child can climb to the elevated platform.

3. The psychologically stimulating changing table of claim 1 wherein the mirror is adjustable.

4. The psychologically stimulating changing table of claim 1 wherein the means for engaging the attention of the child includes storage compartments for different items from which the child can be taught to select the correct item.

5. The psychologically stimulating changing table of claim 1 including means for holding a disposable roll of paper and directing the same lengthwise along the table for aid in maintaining sanitary conditions.

6. The psychologically stimulating changing table of claim 1 comprising a mirror at one end of the elevated platform and a ladder at the other end.

7. The psychologically stimulating changing table of claim 6 comprising additionally means for holding a disposable roll of paper and directing the same lengthwise along the table for aid in maintaining sanitary conditions.

8. A changing table for a child suitable hygienically for a number of children in series comprising:

a. an elevated platform for positioning a child for changing; and b. means for positioning a continuous strip of disposable paper along the platform between the child and the platform and thereby maintaining hygienic conditions along the platform.

* * * * *